United States Patent [19]

Roth

[11] 4,449,349

[45] May 22, 1984

[54] PACKING MACHINE WITH ADJUSTABLE MEANS FOR WEAKENING SELECTED PORTIONS OF CARDBOARD BLANKS OR THE LIKE

[75] Inventor: Oskar Roth, Zufikon, Switzerland

[73] Assignee: Involvo AG, Bünzen, Switzerland

[21] Appl. No.: 324,134

[22] Filed: Nov. 23, 1981

[30] Foreign Application Priority Data

Dec. 3, 1980 [CH] Switzerland ..... 8922/80

[51] Int. Cl.[3] ..... B65B 59/02

[52] U.S. Cl. ..... 53/66; 53/208; 53/389; 53/504; 493/25; 493/397; 493/400

[58] Field of Search ..... 53/66, 64, 504, 208, 53/389; 493/25, 397–404

[56] References Cited

U.S. PATENT DOCUMENTS

| | | | |
|---|---|---|---|
| 1,058,165 | 4/1913 | Erickson | 493/400 X |
| 2,837,012 | 6/1958 | Burroughs | 493/399 X |
| 2,900,882 | 8/1959 | Theobald | 493/397 X |
| 3,022,615 | 2/1962 | Schroeder et al. | 53/66 X |
| 3,478,487 | 11/1969 | Smith et al. | 53/66 |
| 4,085,564 | 4/1978 | Focke | 53/66 X |
| 4,317,319 | 3/1982 | Price | 493/25 X |

*Primary Examiner*—James F. Coan

*Attorney, Agent, or Firm*—Peter K. Kontler

[57] ABSTRACT

A wrap-around packing machine wherein the packing station and the station which supplied prefabricated blanks are separated from each other by a treating unit having a pair of tools serving to provide successive prefabricated blanks with additional fold lines in positions depending on the dimensions of commodities to be wrapped. To this end, the tools are movable toward and away from each other by a reversible motor which receives signals from photocells monitoring the height of commodities to be packed while such commodities advance toward the packing station. The photocells are mounted on a carrier which is movable up and down by the reversible motor so that the photocells come to a halt when they assume certain predetermined positions with reference to the commodities whose height deviates from the height of previously supplied commodities.

10 Claims, 2 Drawing Figures

PACKING MACHINE WITH ADJUSTABLE MEANS FOR WEAKENING SELECTED PORTIONS OF CARDBOARD BLANKS OR THE LIKE

BACKGROUND OF THE INVENTION

The present invention relates to packing machines in general, and more particularly to improvements in packing machines of the type wherein block-shaped or otherwise configurated commodities are draped into prefabricated blanks which are provided with score lines or fold lines to facilitate predictable and convenient folding of blanks around the respective commodities. More particularly, the invention relates to so-called wrap-around packing machines wherein discrete commodities or arrays consisting of groups of two or more commodities are draped into prefabricated blanks so that the blanks constitute envelopes which surround certain sides (preferably at least four sides) or all sides of the commodities. The thus obtained packages are then ready for stacking, storage or transport. As a rule, the blanks are drawn from a magazine and are transported to a packing station which receives commodities from a suitable conveyor. In many instances, the individual constituents of successive commodities are assembled into groups at or close to the packing station prior to placing of the thus obtained commodities onto the respective blanks which are thereupon draped around certain sides or all sides of the respective commodities. The overlapping portions of the blanks can be bonded to each other by resorting to an adhesive or in any other suitable way. The transporting system which delivers blanks from the magazine to the packing station is normally operated in stepwise fashion, preferably in synchronism with the conveyor or conveyors which supply commodities or individual constituents of commodities to the packing station.

In most instances, the magazine stores a stack of completely prefabricated blanks, i.e., blanks whose configuration and dimensions, as well as other characteristics, enable the instrumentalities at the packing station to convert such blanks into envelopes of predictable shape, normally into envelopes which closely hug the outlines of the respective commodities. This involves the application of weakened portions in the form of rows of perforations, score lines or the like so as to ensure that each and every blank of a long series of blanks will be folded and/or otherwise deformed in the same way as the preceding blanks.

If the packing machine is designed to process commodities whose dimensions vary sufficiently to warrant the manufacture of two or more sets of prefabricated blanks, the persons in charge must replace the previously used blanks with a new stack of blanks whenever the packing machine is to be converted from the processing of a first type of commodities to the processing of a different second type of commodities. For example, it is often necessary to make relatively low or relatively tall packages whose outlines are the same, i.e., the width and/or the length of the two types of packages remains unchanged but the height can differ slightly or to a considerable extent. In such instances, the manufactuer of blanks normally produces several types of blanks having identical fold lines for the regions of bottom parts of the various commodities and differently distributed fold lines for the upper parts of the various commodities. In other words, the fold lines which are to facilitate the folding of the top flaps or tucks of blanks are more distant from the fold lines at the bottom portions of envelopes for relatively tall commodities than the fold lines for the folding of top flaps and/or tucks of envelopes for relatively short or low commodities. By way of example, the bottom area of each of a long series of commodities may be a perfect one foot square but the height of a first batch of such long series may be in the range of 10 inches in contrast to the next-following batch of the same series whose height is 20 inches. Under such circumstances, the manufacturer of blanks must furnish two different types of prefabricated blanks whose overall dimensions need not necessarily deviate from each other but the distribution of certain fold lines is quite different. This contributes to the initial cost of the packages and necessitates relatively long interruptions of the packing operation during conversion from the processing of a first type of commodities to the processing of commodities of a different second type.

OBJECTS AND SUMMARY OF THE INVENTION

An object of the invention is to provide a novel and improved packing machine, especially a wrap-around packing machine, which is constructed and assembled in such a way that it can accept and properly process identical blanks even though the dimensions of the commodities to be wrapped into such blanks vary or can vary within a narrow or wide range.

Another object of the invention is to provide a wrap-around packing machine which is constructed and assembled in such a way that it can properly treat tall or low commodities by resorting to a single type of blanks, as long as the area of the bottom surface of each commodity is the same.

A further object of the invention is to provide the packing machine with novel and improved means for weakening selected portions of cardboard blanks, paper blanks, plastic blanks, blanks consisting of metallic foil or blanks consisting of combinations of such materials so that each and every blank can be folded and/or otherwise deformed in a predictable manner.

An additional object of the invention is to provide a novel and improved method of converting identical partly prefabricated blanks into fully prefabricated blanks in dependency on the dimensions of commodities which are to be confined in the blanks.

Another object of the invention is to provide the packing machine with novel and improved means for ensuring that a supply of blanks can be used up, irrespective of whether or not the dimensions of commodities to be wrapped change while the source of supply still contains a smaller or larger quantity of blanks.

A further object of the invention is to provide a packing machine, especially a wrap-around packing machine, which is constructed and assembled in such a way that the transition from the processing of a first type of commodities to the processing of a different second type of commodities can be completed practically or entirely without any reduction of the rate at which the machine turns out finished products.

The invention is embodied in a packing machine wherein block-shaped or otherwise configurated commodities of varying dimensions (especially varying height) are draped into paper blanks, cardboard blanks or analogous blanks having weakened portions which constitute fold lines for convenient and predictable conversion of such blanks into envelopes for the respective commodities (each commodity can constitute a separate entity or a group of properly arrayed entities). The packing machine comprises means (e.g., a suitable belt or chain conveyor and means for advancing the conveyor in stepwise fashion) for transporting a succession of blanks in a predetermined direction along a predetermined (preferably horizontal or substantially horizontal) path, a packing station adjacent to a first portion of the path, and a novel and improved blank treating unit adjacent to a second portion of the path ahead of the first portion, as considered in the predetermined direction. The blank treating unit comprises blank weakening means including at least one tool (but preferably two tools having parallel blank-engaging portions), means for moving the tool at least once (and preferably only once) toward and away from the path into and from engagement with successive blanks on advancement of such blanks into the second portion of the path, and support means (e.g., a pair of stationary arms) for the tool. The tool is movable with reference to the support means (either by hand but preferably by prime mover means) between a plurality of different positions relative to the second portion of the path so that it can engage and weaken a different portion of a blank in each of its different positions.

The packing machine preferably further comprises a magazine or an analogous source of supply of blanks, and one or more suction cups or other suitable means for transferring blanks from the source into a third portion of the path ahead of the second portion, as considered in the direction of advancement of blanks along the path.

Still further, the packing machine preferably comprises means for feeding to the first portion of the path commodities of varying dimensions, and means for monitoring the dimensions (especially the height) of the commodities which are about to be draped into blanks at the packing station. The feeding means can comprise a continuously or intermittently driven conveyor defining a second path along which the commodities advance to the packing station, i.e., into the third portion of the predetermined path, and the monitoring means can be installed adjacent to the second path.

The aforementioned blank treating unit preferably further comprises means for moving the tool between the aforementioned different positions. The monitoring means preferably comprises at least one photocell or other suitable detector means for generating signals denoting the dimensions of the monitored commodities, and the treating unit preferably further comprises means for actuating the moving means in response to such signals so that the selected position of the tool or tools is a function of the dimensions of monitored commodities. If the blank weakening means comprises two tools, the moving means preferably includes means for moving the two tools nearer to or further away from each other. Such tools are preferably located at a level above the second portion of the predetermined path.

The blank treating unit preferably further comprises first and second guide means provided on the support means and each arranged to support a tool for movement toward and away from blanks in the second portion of the path. The moving means preferably comprises a reversible electric motor or analogous reversible prime mover means and means for moving the tools nearer to or further away from each other in response to actuation of the prime mover means. The just mentioned means for moving the tools nearer to or further away from each other can comprise a feed screw which receives torque from the reversible prime mover means and has oppositely inclined first and second threads meshing with the respective guide means.

The photocell or photocells of the monitoring means preferably generate signals denoting the height of the monitored commodities so that the prime mover means of the means for moving the tool or tools is actuated (e.g., by way of a suitable control circuit connected with the output or outputs of the monitoring means) in response to height-indicating signals, i.e., the selected distance between the tools (if the blank-weakening means comprises several tools) is a function of the height of monitored commodities.

In accordance with a further feature of the invention, the packing machine preferably comprises means for moving the monitoring means between a plurality of different positions in response to actuation of the prime mover means (i.e., in response to movement of the tool or tools to a different position) so that each position of the tool or tools corresponds to a different position of the monitoring means. The means for moving the monitoring means can comprise a suitable carrier (e.g., a mobile plate-like member and a nut fixedly installed in or otherwise secured to the plate-like member) for the monitoring means, a feed screw meshing with the carrier (i.e., with the aforementioned nut on the fixed plate like member), and means for transmitting torque from the reversible prime mover means to such feed screw so that the feed screw can displace the monitoring means by way of the carrier.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
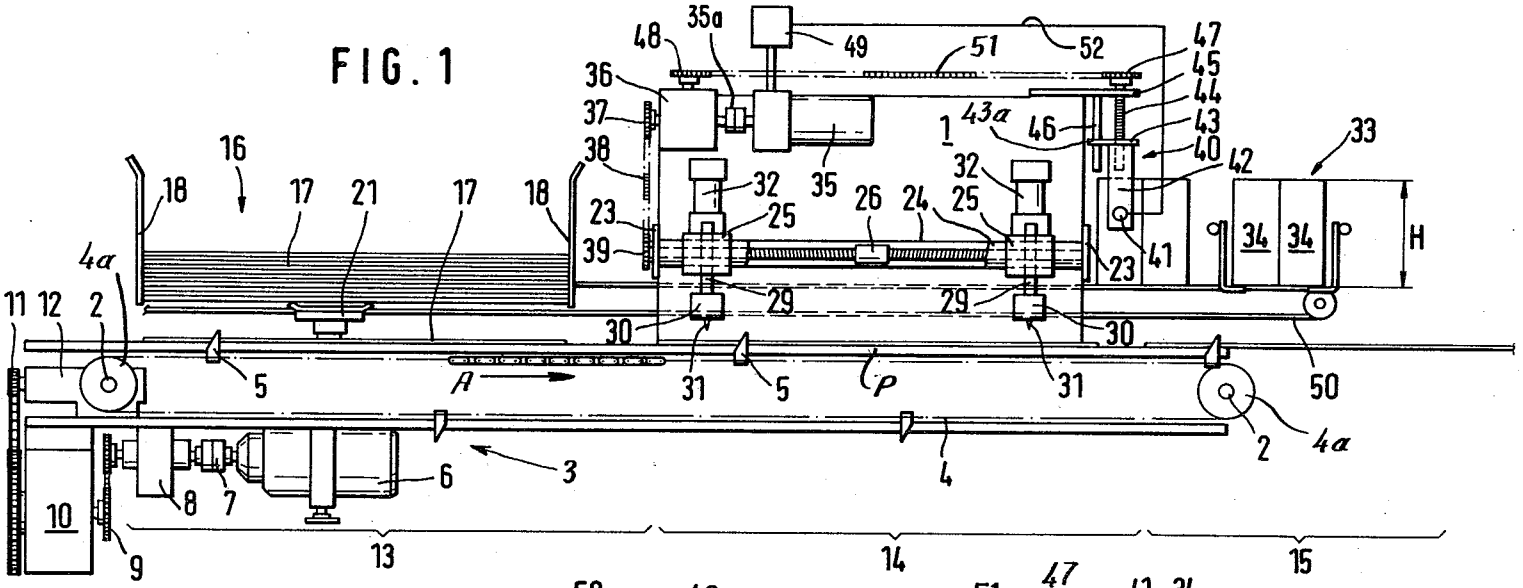
FIG. 1 is a somewhat schematic side elevational view of a packing machine which embodies one form of the invention and wherein the blank-weakening means of the blank treating unit comprises two discrete tools which are movable toward and away from each other.
Figure 2:
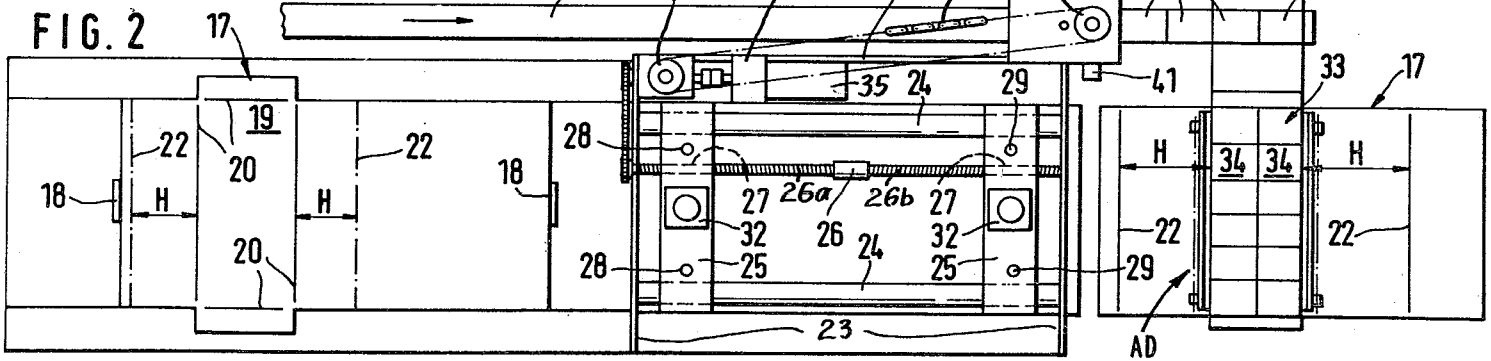
FIG. 2 is a somewhat schematic plan view of the packing machine which is shown in FIG. 1.

The packing machine which is shown in FIGS. 1 and 2 comprises a frame 1 for the rotary shafts 2 of a blank transporting device 3 including an endless belt or chain conveyor 4 with sprocket wheels or pulleys **4*a* and outwardly extending equidistant entraining elements or pushers 5 for discrete prefabricated blanks 17. The means for advancing the conveyor 4 of the transporting device 3 stepwise comprises an electric motor 6 or another suitable main prime mover, a mechanical clutch 7 which receives torque from the output shaft of the motor 6, an electromagnetic clutch 8 which receives torque from the clutch 7, a first chain-and-sprocket drive 9 which is driven by the clutch 8, a transmission 10 (such as a geneva movement) whose input element receives torque from the drive 9 and whose output element performs intermittent angular movements, a second chain-and-sprocket drive 11 receiving intermittent motion from the transmission 10, and a bevel gear transmission 12 which receives torque from the drive 11 and serves to intermittently rotate the adjacent shaft 2 so that the upper reach of the conveyor 4 advances in the direction of arrow A at predetermined intervals and through predetermined distances corresponding to those between neighboring pushers 5. The intermittent or stepwise movements of the conveyor 4 are synchronized with movements of other component parts of the packing machine. The upper reach of the conveyor 4 defines an elongated path which is preferably horizontal or substantially horizontal and the right-hand end portion of which is adjacent to a packing station 15. The median or second portion of the path is adjacent to a novel and improved blank treating unit 14, i.e., a unit which is located ahead of the packing station 15, as considered in the direction of arrow A, and a third portion of the path is adjacent to a station 13 for a magazine 16 or another suitable source of supply of prefabricated blanks 17. It will be noted that the just mentioned third portion of the path which is defined by the upper reach of the conveyor 4 is located ahead of the blank treating unit 14**, as considered in the direction of arrow A.

The exact details of the magazine 16 and of the instrumentalities at the packing station 15 form no part of the present invention. It suffices to say that the instrumentalities at the station 15 are designed to convert successive blanks 17 into envelopes each of which surrounds at least four sides of a substantially block-shaped one-piece or composite commodity 33. In the illustrated embodiment, each commodity 33 consists of twelve properly arrayed individual block-shaped packets of constituents 34 which form two parallel rows extending transversely of the path of movement of blanks 17 with the upper reach of the conveyor 4.

The magazine 16 has two upright side walls 18 which allow for accurate stacking of superimposed blanks 17 therein, and this magazine cooperates with one or more suction cups 21 or analogous means for transferring successive lowermost blanks 17 from the magazine 16 into the adjacent portion of the path along which the blanks 17 advance with the oncoming pushers 5 in the direction of arrow A.

As can be seen in FIG. 2, each prefabricated blank 17 is formed with four weakened portions 20 which include a pair of relatively short and a pair of relatively long fold lines and can be formed by scoring, perforating or any other suitable blank-weakening tools, not shown. The fold lines 20 surround an area 19 whose dimensions correspond to those of the bottom surface or underside of a fully assembled commodity 33 at the packing station 15. In order to ensure predictable, neat and reproducible folding or draping of successive blanks 17 around the respective commodities 33, each blank must or should be further provided with at least two additional fold lines or weakened portions 22 which are shown by phantom lines in the left-hand portion and by solid lines in the right-hand portion of FIG. 2. The purpose of the treating unit 14 at the station between the packing station 15 and the station 13 for the magazine 16 and blank transferring means 21 is to provide each oncoming blank 17 with two parallel fold lines 22 so that such blank can be properly draped around a commodity 33 upon its arrival at the packing station 15. The distance between the fold lines 22 and the nearest fold lines of the pair of longer fold lines 20 equals H and corresponds to the height of a fully assembled commodity 33, i.e., to the height of an upstanding constituent or packet 34 of such commodity.

The suction cup or cups 21 transfer a discrete flat prefabricated blank 17 from the lowermost portion of the magazine 16 onto the upper reach of the conveyor 4 or onto a stationary platform P between the upper reach of the conveyor 4 and the magazine 16 before the sprocket wheels or pulleys **2*a* are set in motion or while the conveyor 4 is in motion, as long as the freshly delivered blank 17 descends into the path of movement of the oncoming pusher 5 which thereupon advances the blank through a predetermined distance and comes to rest when the blank is properly located in the path portion which is adjacent to the treating unit 14**.

The unit 14 comprises blank weakening means including two elongated tools 31 which extend transversely of the upper reach of the conveyor 4 and of the blank 17 thereon and are movably carried by a support including two parallel horizontal arms 23 extending from the frame 1. The support further includes two elongated horizontal tie rods 24 which are mounted in the arms 23 and extend in parallelism with the direction (arrow A) of movement of blanks 17 with the respective pushers 5. The tie rods 24 support two reciprocable guides 25 in the form of crossheads which are movable toward and away from each other and each of which supports the vertical shank 29 for one of the tools 31. More specifically, the lower end portions of the shanks 29 carry holders 30 for the respective tools 31 each of which can be provided with an elongated scoring edge or with a row of perforating needles, depending on the nature of fold lines 22 which are to be applied to the blanks 17.

The means for moving the tools 31 toward or away from each other (as considered in the longitudinal direction of the upper reach of the conveyor 4) comprises a prime mover 35 which is or may constitute a reversible electric motor and can drive a bevel gear transmission 36 through the medium of a clutch **35*a*. The moving means for the tools 31 further comprises a chain-and-sprocket drive (or a belt-and-pulley drive) including a first sprocket wheel or pulley 37 on the respective output element of the transmission 36, a second sprocket wheel or pulley 39 at one end of a horizontal feed screw 26, and a chain or belt 38 which is trained over the sprocket wheels or pulleys 37, 39. The end portions of the feed screw 26 are rotatably journalled in the arms 23, and this feed screw has two sets of oppositely inclined threads 26*a*, 26*b* which respectively mate with internal threads 27 provided in the corresponding guides 25. Thus, when the motor 35 is actuated to rotate the feed screw 26 in a first direction, the two tools 31 move nearer to each other, but the distance between such tools increases when the motor 35 is actuated to rotate the feed screw 26 in the opposite direction. The internally threaded portions of the guides 25 can be said to constitute two fixed nuts which cause the respective guides to move lengthwise of the tie rods 24 in response to rotation of the feed screw 26**.

Each of the guides 25 can support two spaced-apart parallel vertical cylindrical shanks 29 for the respective tool holders 30 to thus reduce the likelihood of misorientation of the tools 31 during movement with respect to the corresponding guides 25 and/or during engagement with the blank 17 therebelow. The shanks 29 are reciprocable in complementary vertical cylindrical bores 28 of the respective guides 25. The tools 31 may be commercially available parts of the type often used in the manufacture of blanks which are processed in wrap-around and/or other types of packing machines. The manner in which the tools 31 are preferably removably installed in their respective holders 30 forms no part of the invention and, therefore, the details of means for retaining the tools in their holders are not specifically shown in the drawing.

Each of the guides 25 supports an upright fluid-operated motor 32, such as a double-acting pneumatic cylinder and piston assembly whose cylinder is affixed to the respective guide and whose piston rod extends through a suitable bore in the respective guide and is affixed to the corresponding holder 30 midway between the adjacent shanks 29. When the upper chambers of the cylinders of the motors 32 receive a pressurized fluid, the piston rods move downwardly and cause the edges or needles at the undersides of the tools 31 to engage and score or perforate the adjacent portions of the blank 17 therebelow, i.e., to provide such blank with the aforediscussed fold lines 22. The distance between such fold lines and the longer fold lines 20 of the respective blank 17 depends on the selected distance between the holders 30 for the tools 31, i.e., on the distances between the guides 25 and the nearest arms 23 of the support for the blank-weakening means.

Since the motors 32 are mounted on the guides 25, they can reciprocate the tools 31 relative to such guides (by moving the tools toward and away from the blank 17 therebelow) irrespective of the selected distance between the two tools. The connections between a suitable source of pressurized fluid (such as an air compressor) and the chambers of the cylinders forming part of the motors 32 are not shown in the drawing. These motors 32 are actuated to move the tools 31 downwardly when the conveyor 4 comes to a halt, i.e., when a blank 17 is properly positioned at the station for the treating unit 14. Those portions of the blanks 17 at the station for the unit 14 which are about to be engaged by the working edges or portions of the tools 31 preferably rest on a suitable back support, such as the corresponding portion of the aforementioned platform P. This ensures that the blanks 17 are properly scored or perforated so that each of the fold lines 22 exhibits the same resistance or lack of pronounced resistance to flexing during folding at the packing station 15.

The pneumatic motors 32 can be replaced with hydraulically operated motors or with electromagnetically or otherwise operated means for moving the tools 31 toward and away from the path of blanks 17 on the conveyor 4, i.e., substantially vertically and at right angles to the plane of a blank 17 at the station for the treating unit 14.

If the height of a next batch of commodities exceeds the height H of the commodity 33 which is shown in FIG. 1, the distance between the tools 31 must be changed by actuating the motor 35 in a direction to move the guides 25 nearer to or further away from each other. The overall dimensions of the blanks 17 can be readily selected in such a way that one and the same blank can be used for the making of an envelope around a relatively low or around a relatively tall commodity, i.e., there is ample room to place the fold lines 22 nearer to or further away from the respective longer fold lines 20 without affecting the ability of the blank to properly surround at least four sides of the respective commodity 33.

Once a blank 17 has been properly scored or perforated at the station for the treating unit 14, the conveyor 4 is set in motion again to advance such blank to the packing station 15 where the blank is held in requisite position for the placing of a freshly or previously assembled commodity 33 onto the area 19 which is surrounded by the four original fold lines 20. At the same time, the tools 31 apply two fold lines 22 to the next-following blank 17.

The means for feeding packets 34 of commodities 33 to the packing station 15 comprises a continuously driven endless belt or chain conveyor 50 which receives individual constituents 34 from a suitable source (not shown) and delivers such constituents to a suitable arraying device AD shown in the right-hand portion of FIG. 2 and serving to accumulate groups of twelve packets 34 into successive composite commodities 33 which are placed onto successive blanks 17 at the station 15 in such a way that the bottom surfaces of all twelve packets 34 in a commodity 33 rest on the area 19 of the respective blank.

The attendant in charge could start the motor 35 in the proper direction whenever a series of packets 34 having a first height is followed by a series of packets having a different second height. This would necessitate repeated or continuous observation of the packets 34 arriving on the conveyor 50. In fact, the motor 35 can be omitted and the feed screw 26 can be rotated by hand (e.g., by a crank, wrench or the like). In order to eliminate such task, the improved machine is preferably provided with means for automatically changing the positions of tools 31 when the dimensions of packets on the conveyor 50 change, either by causing the motor 35 to move the tools 31 nearer to each other or by causing the motor to move such tools apart. The provision of means for automatically changing the distance between the tools 31 in response to a change in the dimensions of packets which are supplied by the conveyor 50 ensures that the change of setup (insofar as the dimensions of packets to be wrapped are concerned) can be effected with little or no delay and also that an attendant need not be present when such change takes place.

The means for effecting automatic adjustments in the relative positions of tools 31 comprises monitoring means 40 which serves to ascertain the height H of each oncoming packet 34 in the path which is defined by the conveyor 50 and to generate signals which are indicative of the monitored height. The illustrated monitoring means 40 comprises two photocells 41 mounted on two upright arms 42 extending downwardly from a carrier here shown as including a plate-like member 43 having a nut **43*a* which meshes with a vertical feed screw 44 driven by a belt or chain transmission including a first sprocket wheel or pulley 48 on a second output element of the transmission 36, a second sprocket wheel or pulley 47 affixed to the feed screw 44 and an endless chain or belt 51 trained over the parts 47 and 48. The feed screw 44 is freely rotatable in a stationary extension 45 of the frame 1. A vertical guide post 46 on the extension 45 extends through a hole of the plate-like member 43 to hold the photocells 41 against angular displacement about the axis of the feed screw 44 when the latter is rotated to move the photocells 41 up or down, as viewed in FIG. 1. FIG. 2 shows that the photocells 41 are disposed opposite each other at the respective sides of the path which is defined by the conveyor 50**.

The photosensitive transducers of the photocells 41 transmit signals to the actuating circuit 49 for the motor 35 via conductor means 52. The motor 35 then moves the tools 31 toward or away from each other (depending on the signs of signals which are transmitted by the photocells) and, at the same time, the motor 35 causes the photocells 41 to move up or down. The photocells 41 measure the height of the packets 34 therebetween and transmit signals corresponding to different gray scale values. Such signals are compared with reference signals in the actuating circuit 49, namely, with signals denoting those values on the gray scale which correspond to signals generated by the photocells 41 when one-half of their diameters extends above and the remaining half is located below the plane of the upper side of a packet 34 on the conveyor 50. If the intensity of signals which are furnished by the photocells 41 exceeds or is less than the reference value, the motor 35 is caused to rotate in the appropriate direction until the photocells 41 assume the just outlined desired positions with reference to the packets 34 on the conveyor 50. The motor 35 is then arrested and the tools 31 are automatically positioned at the required distance from each other, i.e., the fold lines 22 are then formed at the required distance from the longer fold lines 20 of blanks 17 at a level below the treating unit 14. The just described automatic adjusting system for the knives 31 ensures that the packing machine need not be arrested when the packets 34 having a first height H are followed by packets whose height deviates from (i.e., is greater or less than) the height H.

The improved packing machine can embody two or even more blank treating units between the magazine for blanks and the packing station, depending on the desired number of fold lines which are to be applied to blanks on their way toward the packing station. Furthermore, the magazine 16 can store blanks which are without any fold lines, and an additional treating unit can be installed ahead of the unit 14 to provide the fold lines 20 before the unit 14 applies the fold lines 22.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In a packing machine wherein commodities are draped into blanks having weakened portions constituting fold lines for conversion of such blanks into envelopes for the respective commodities, the combination of means for transporting a succession of blanks in a predetermined direction along a predetermined path; a packing station adjacent to a first portion of said path; means for feeding commodities of varying dimensions to said first portion of said path; a blank treating unit adjacent to a second portion of said path ahead of said first portion, as considered in said direction, said unit comprising blank weakening means including a pair of tools, means for moving said tools at least once toward and away from said path into and from engagement with successive balnks on advancement of such blanks into said second portion of said path, support means for said tools, said tools being movable with reference to said support means between a plurality of different positions relative to said second portion of said path so that the tools can engage and weaken different portions of a blank in each of said different positions thereof, means for moving said tools between said different positions including reversible prime mover means and means for moving said tools nearer to and further away from each other in response to actuation of said prime mover means, and first and second guide means on said support means, one for each of said tools, said tools being movable in the respective guide means toward and away from the blanks in said second portion of said path; means for monitoring the dimensions of commodities which are about to be draped into blanks in said first portion of said path, including means for generating signals which denote the height of commodities; means for actuating said prime mover means in response to said signals to that the selected distance between said tools is a function of the height of monitored commodities; and means for moving said monitoring means between a plurality of different positions in response to actuation of said prime mover means so that each position of said tools corresponds to a different position of said monitoring means, including a mobile carrier for said monitoring means, a feed screw meshing with said carrier and means for transmitting torque from said prime mover means to said feed screw.

2. The combination of claim 1, wherein said transporting means comprises a conveyor and means for advancing said conveyor stepwise.

3. The combination of claim 1, further comprising a source of supply of blanks and means for transferring blanks from said source into a third portion of said path ahead of said second portion, as considered in said direction.

4. The combination of claim 1, wherein said tools have elongated parallel blank-engaging portions.

5. The combination of claim 1, wherein said feeding means defines a second path along which the commodities are advanced to said packing station, said monitoring means being adjacent to said second path.

6. The combination of claim 1, wherein said means for moving said tools nearer to or further away from each other comprises a second feed screw receiving torque from said prime mover means and having oppositely inclined first and second threads mating with the respective guide means.

7. The combination of claim 1, wherein said monitoring means comprises at least one photocell.

8. The combination of claim 1, wherein said second portion of said path is located at a level below said tools.

9. The combination of claim 1, wherein said carrier comprises a plate-like member and a nut provided on said plate-like member and meshing with said feed screw.

10. In a packing machine wherein commodities are draped into blanks having weakened portions constituting fold lines for conversion of such blanks into envelopes for the respective commodities, the combination of means for transporting a succession of blanks in a predetermined direction along a predetermined path; a packing station adjacent to a first portion of said path; means for feeding commodities of varying heights to said first portion of said path; a blank treating unit adjacent to a second portion of said path ahead of said first portion, as considered in said direction, said unit comprising blank weakening means including at least one tool, means for moving said tool at least once toward and away from said path into and from engagement with successive blanks on advancement of such blanks into said second portion of said path, support means for said tool, said tool being movable with reference to said support means between a plurality of different positions relative to said second portion of said path so that the tool can engage and weaken a different portion of a blank in each of said different positions thereof, means for moving said tool between said different positions including prime mover means and means for moving said tool in response to actuation of said prime mover means, and guide means on said support means, said tool being movable in said guide means toward and away from the blanks in said second portion of said path; means for monitoring the dimensions of commodities which are about to be draped into blanks in said first portion of said path, including means for generating signals which denote the height of commodities; means for actuating said prime mover means in response to said signals so that the selected position of said tool is a function of the height of monitored commodities; and means for moving said monitoring means between a plurality of different positions in response to actuation of said prime mover means so that each position of said tool corresponds to a different position of said monitoring means, including a mobile carrier for said monitoring means and means for transmitting motion from said prime mover means to said carrier.

* * * * *